US011592174B2

(12) United States Patent
Cadima

(10) Patent No.: US 11,592,174 B2
(45) Date of Patent: Feb. 28, 2023

(54) GAS BURNER WITH A PNEUMATIC ACTUATING INJET

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 254 days.

(21) Appl. No.: 16/045,055

(22) Filed: Jul. 25, 2018

(65) Prior Publication Data

US 2020/0032999 A1 Jan. 30, 2020

(51) Int. Cl.

| | |
|---|---|
| ***F23D 14/34*** | (2006.01) |
| ***F24C 3/12*** | (2006.01) |
| ***F23N 1/02*** | (2006.01) |

(52) U.S. Cl.

CPC ..... *F23D 14/34* (2013.01); *F23N 1/027* (2013.01); *F24C 3/126* (2013.01)

(58) Field of Classification Search

CPC .. F24C 3/126; F23L 13/00; F23L 5/00; F23D 14/34; F23D 14/065; F23D 14/02; F23N 1/027; F23N 1/025

USPC ..... 126/39 e

See application file for complete search history.

(56) References Cited

U.S. PATENT DOCUMENTS 3,525,325 A 8/1970 Perl
4,340,355 A * 7/1982 Nelson ..... F23N 5/025 431/20
4,424,793 A 1/1984 Cooperrider
4,436,506 A * 3/1984 Berkhof ..... F23N 5/006 431/76
4,752,213 A * 6/1988 Grochowski ..... F23D 14/02 431/328
4,793,798 A * 12/1988 Sabin ..... F23D 14/22 431/90
4,953,534 A 9/1990 De Gouville et al.
5,520,533 A * 5/1996 Vrolijk ..... F23N 1/027 431/90
5,630,408 A * 5/1997 Versluis ..... F23N 1/027 122/14.21

(Continued)

FOREIGN PATENT DOCUMENTS

CN 1076516 A 9/1993
EP 0887590 A1 12/1998

(Continued)

*Primary Examiner* — Steven B McAllister
*Assistant Examiner* — John E Bargero
(74) *Attorney, Agent, or Firm* — Dority & Manning, P.A.

(57) ABSTRACT

A gas burner includes a burner body that defines a plurality of forced induction flame ports. An air outlet orifice is mounted to an injet body at an outlet of an air passage such that the air outlet orifice is oriented for directing a flow of air towards the plurality of forced induction flame ports. A gas outlet orifice is mounted to the injet body at an outlet of a gas passage such that the gas outlet orifice is oriented for directing a flow of gaseous fuel towards the plurality of forced induction flame ports. A pneumatically actuated gas valve is positioned within the injet body. The pneumatically actuated gas valve is configured to adjust from a closed configuration to an open configuration in response to the flow of air through the air passage.

20 Claims, 9 Drawing Sheets

(56) References Cited

U.S. PATENT DOCUMENTS

| | | | | |
|---|---|---|---|---|
| 5,937,846 | A * | 8/1999 | Martin | F24C 3/128 126/39 E |
| 6,312,250 | B1 * | 11/2001 | Neville | F23D 14/60 431/1 |
| 6,322,354 | B1 | 11/2001 | Carbone et al. | |
| 6,537,065 | B1 | 3/2003 | Shirali et al. | |
| 8,479,721 | B2 | 7/2013 | Graham et al. | |
| 8,845,326 | B2 | 9/2014 | Shaffer et al. | |
| 8,960,234 | B2 | 2/2015 | Cadeau et al. | |
| 2005/0221243 | A1 | 10/2005 | Najewicz et al. | |

FOREIGN PATENT DOCUMENTS

| | | | |
|---|---|---|---|
| JP | 2000314510 | A | 11/2000 |
| JP | 4565203 | B2 | 10/2010 |
| KR | 100838429 | B1 | 6/2008 |

* cited by examiner

GAS BURNER WITH A PNEUMATIC ACTUATING INJET

FIELD OF THE INVENTION

The present subject matter relates generally to gas burners, such as forced induction gas burners.

BACKGROUND OF THE INVENTION

Conventional gas cooking appliances have one or more burners. A mixture of gaseous fuel and air combusts at the burners to generate heat for cooking. Known burners frequently include an orifice and Venturi mixing throat. A jet of gaseous fuel between the orifice and the Venturi mixing throat entrains air into the Venturi mixing throat with the jet of gaseous fuel. The air and gaseous fuel mix within the Venturi mixing throat, and the mixture of gaseous fuel and air is combusted at flame ports of the burners. Such burners are generally referred to as naturally aspirated gas burners.

Naturally aspirated gas burners can efficiently burn gaseous fuel. However, a power output of naturally aspirated gas burners is limited by the ability to entrain a suitable volume of air into the Venturi mixing throat with the jet of gaseous fuel. To provide increased entrainment of air, certain gas burners include a fan or pump that supplies pressurized air for mixing with the jet of gaseous fuel. Such gas burners are generally referred to as forced induction gas burners.

While offering increased power, known forced induction gas burners suffer from various drawbacks. For example, known forced induction gas burners are bulky and occupy large volumes within cooktop appliances. In addition, plumbing of the gas/air lines within known forced induction gas burners is complex and costly.

BRIEF DESCRIPTION OF THE INVENTION

Aspects and advantages of the invention will be set forth in part in the following description, or may be apparent from the description, or may be learned through practice of the invention.

In a first example embodiment, a gas burner includes a burner body that defines a plurality of forced induction flame ports. The gas burner also includes a gas outlet orifice and an air outlet orifice. An injet body defines an air passage and a gas passage. The air outlet orifice is mounted to the injet body at an outlet of the air passage such that the air outlet orifice is oriented for directing a flow of air towards the plurality of forced induction flame ports. The air passage is configured for directing the flow of air through the injet body to the air outlet orifice. The gas outlet orifice is mounted to the injet body at an outlet of the gas passage such that the gas outlet orifice is oriented for directing a flow of gaseous fuel towards the plurality of forced induction flame ports. The gas passage is configured for directing the flow of gaseous fuel through the injet body to the gas outlet orifice. A pneumatically actuated gas valve is positioned within the injet body. The pneumatically actuated gas valve is adjustable between a closed configuration and an open configuration. The pneumatically actuated gas valve blocks the flow of gaseous fuel through the gas passage in the closed configuration. The pneumatically actuated gas valve is configured to adjust from the closed configuration to the open configuration in response to the flow of air through the air passage.

In a second example embodiment, a gas burner includes a burner body that defines a plurality of forced induction flame ports. An air outlet orifice is configured for directing pressurized air towards the plurality of forced induction flame ports. A gas outlet orifice is configured for directing gaseous fuel towards the plurality of forced induction flame ports. An injet body defines an air passage and a gas passage. The air outlet orifice is mounted to the injet body at an outlet of the air passage. The gas outlet orifice is mounted to the injet body at an outlet of the gas passage. A pneumatically actuated gas valve is positioned within the injet body. The pneumatically actuated gas valve blocks a flow of gaseous fuel in the gas passage when the pneumatically actuated gas valve is closed. The pneumatically actuated gas valve is configured to open in response to pressurizing the air passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a top, plan view of a cooktop appliance according to an example embodiment of the present disclosure.

DETAILED DESCRIPTION

Figure 7:
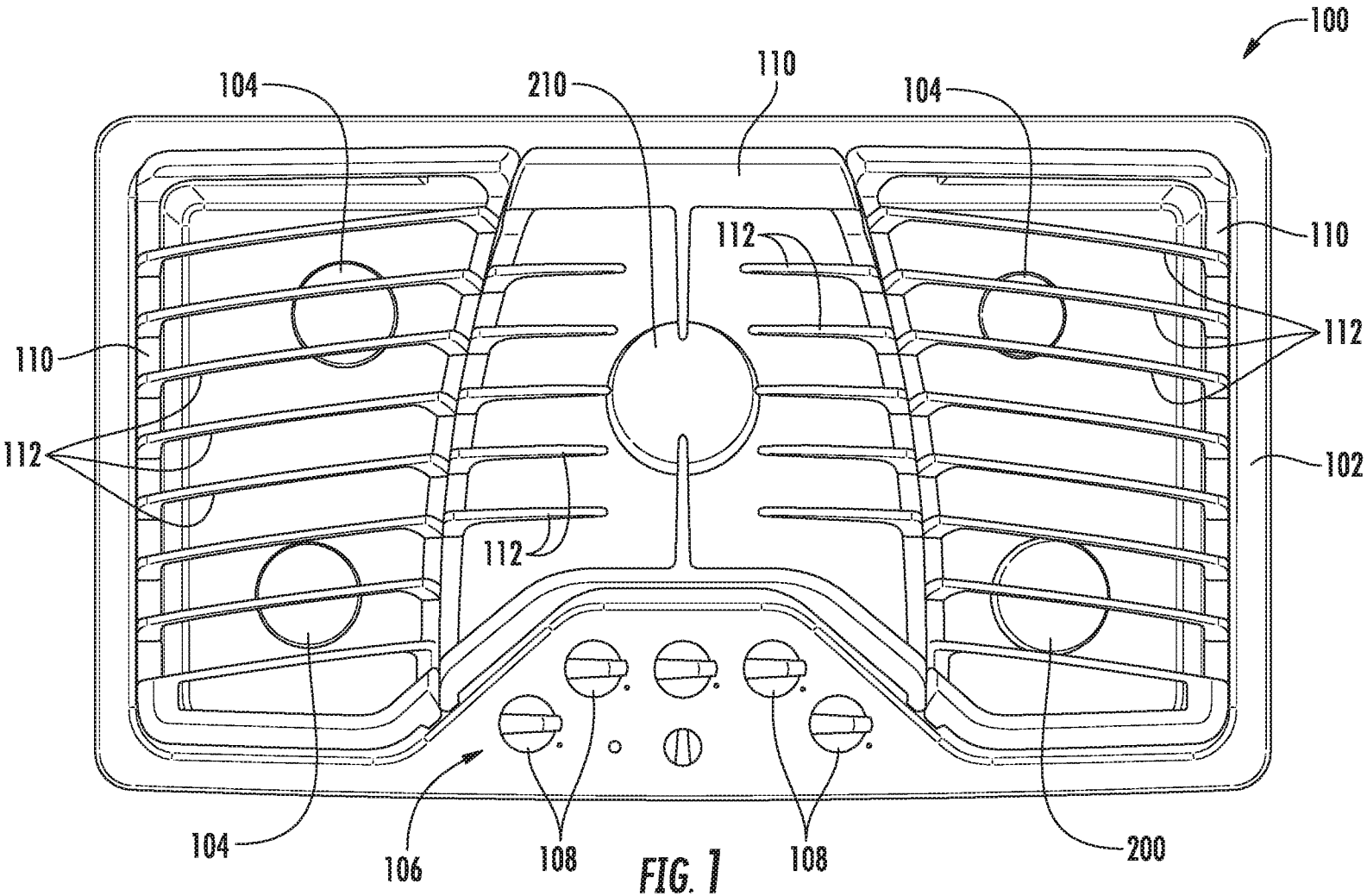
FIG. 7 is a section view of the example gas burner of FIG. 4.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner for a cooktop appliance 100. Although cooktop appliance 100 is used below for the purpose of explaining the details of the present subject matter, it will be appreciated that the present subject matter may be used in or with any other suitable appliance in alternative example embodiments. For example, the gas burner described below may be used on other types of cooking appliances, such as single or double oven range appliances. Cooktop appliance 100 is used in the discussion below only for the purpose of explanation, and such use is not intended to limit the scope of the present disclosure to any particular style of appliance.

FIG. 1 illustrates an example embodiment of a cooktop appliance 100 of the present disclosure. Cooktop appliance 100 may be, e.g., fitted integrally with a surface of a kitchen counter or may be configured as a slide-in cooktop unit. Cooktop appliance 100 includes a top panel 102 that includes one or more heating sources, such as heating elements 104 for use in, e.g., heating or cooking. In general, top panel 102 may be constructed of any suitably rigid and heat resistant material capable of supporting heating elements 104, cooking utensils, grates 110, and/or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. For this example embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

Cooktop appliance 100 is generally referred to as a "gas cooktop," and heating elements 104 are gas burners. For example, one or more of the gas burners in cooktop appliance may be a gas burner 300 described below. As illustrated, heating elements 104 are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
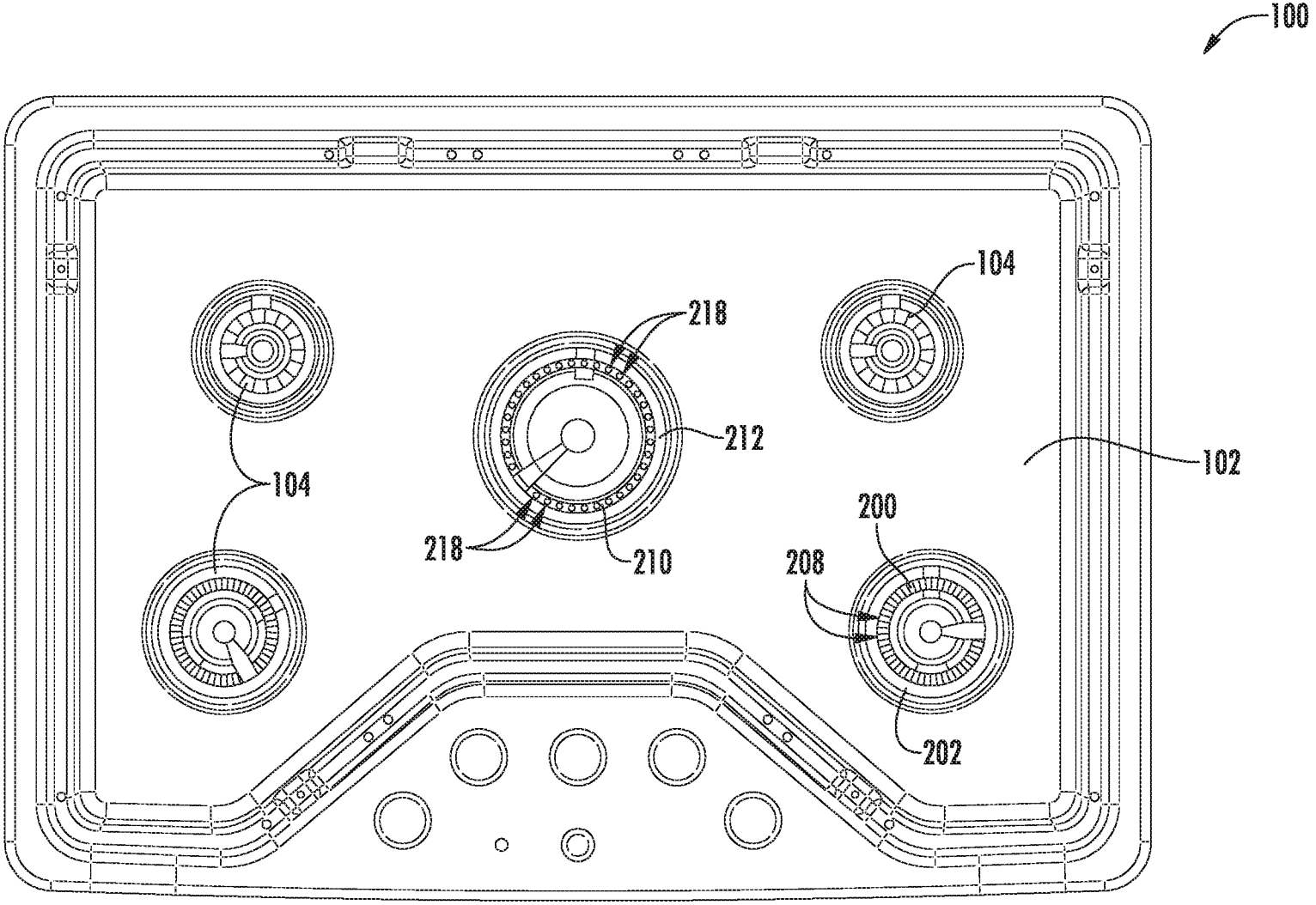
FIG. 2 is a top plan view of the example cooktop appliance of FIG. 1 with grates removed from a top panel of the example cooktop appliance.
Figure 3:
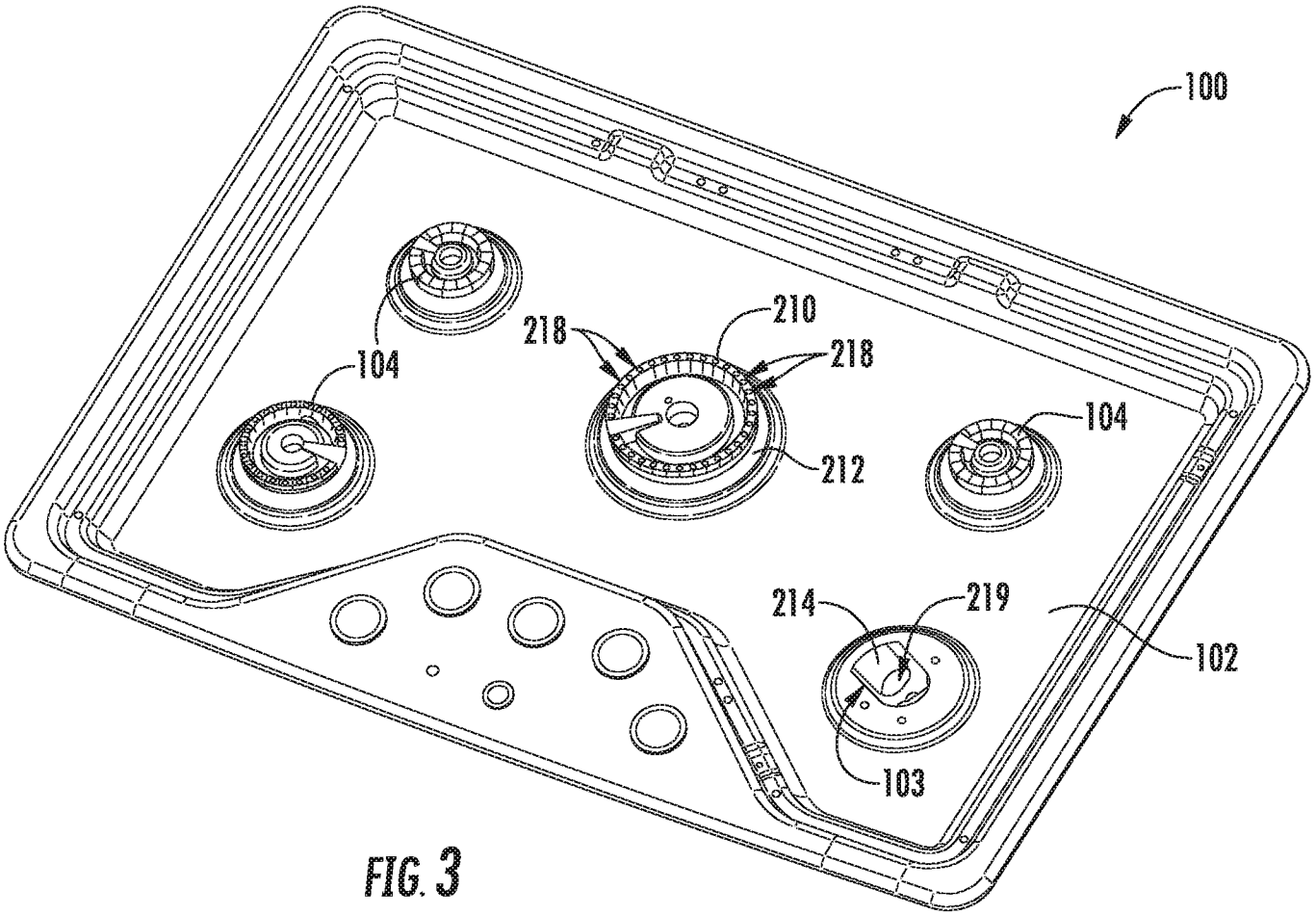
FIG. 3 is a top, perspective view of the example cooktop appliance of FIG. 2 where a first heating element is removed from the top panel of the example cooktop appliance.
Figure 4:
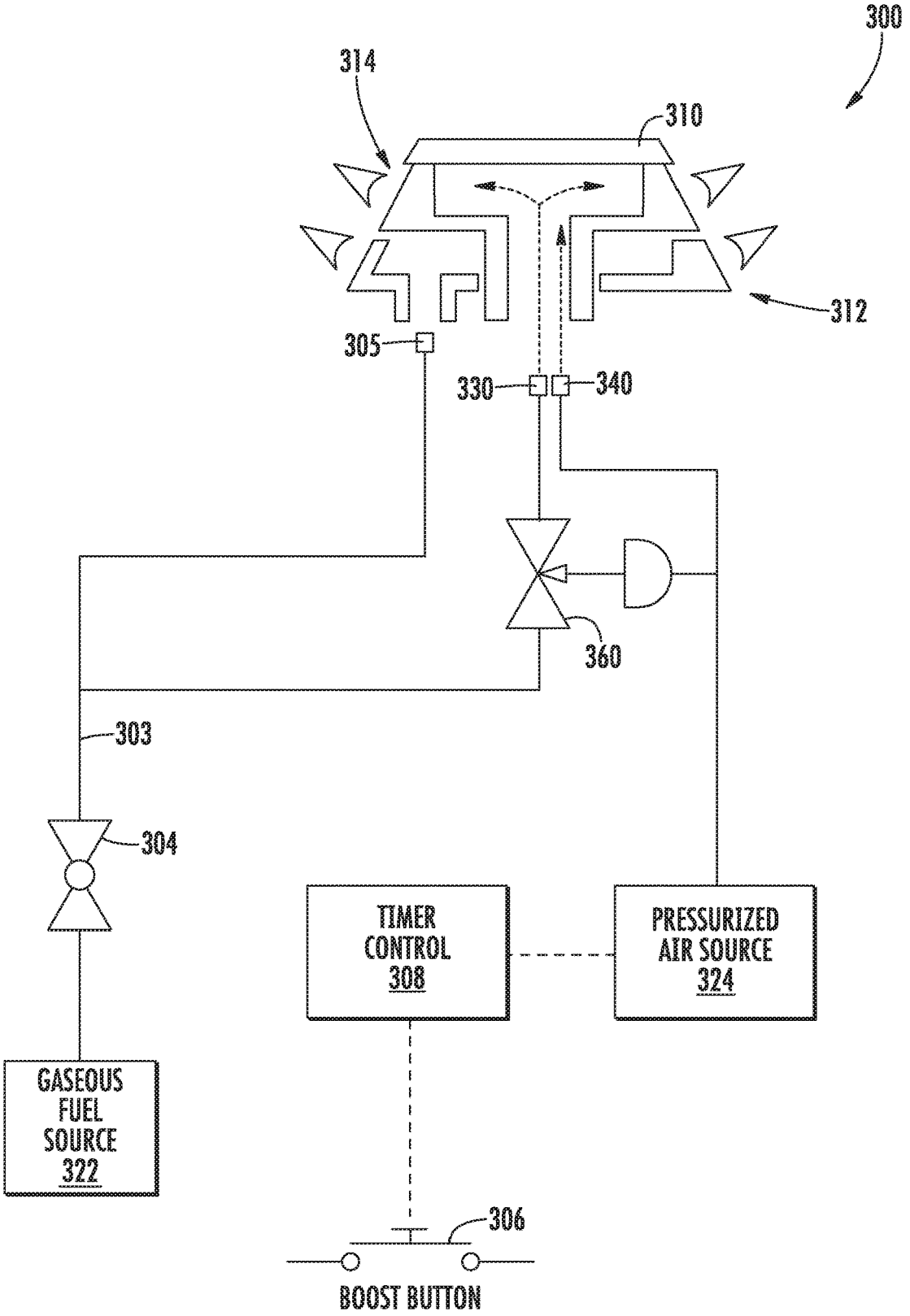
FIG. 4 is a schematic view of a gas burner according to an example embodiment of the present disclosure.
Figure 5:
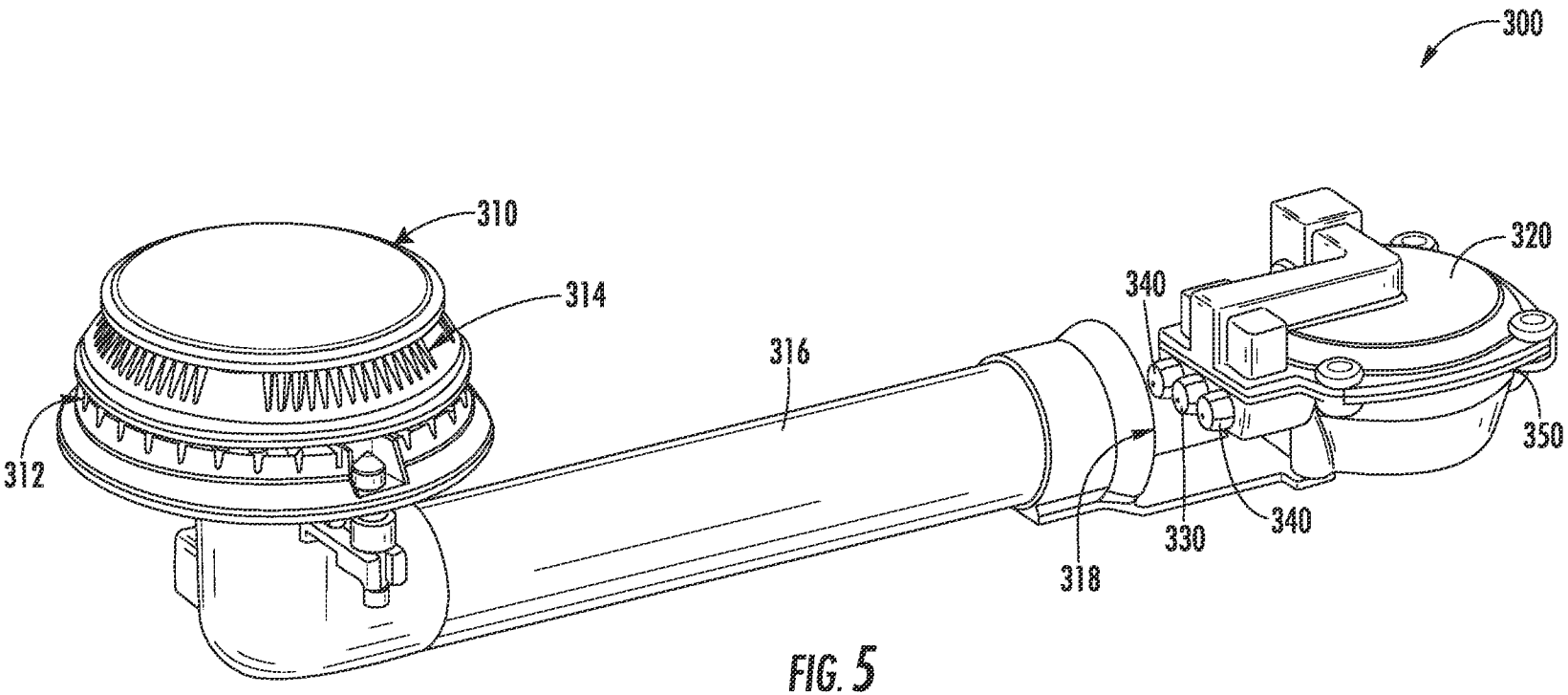
FIG. 5 is a perspective view of the example gas burner of FIG. 4.
Figure 6:
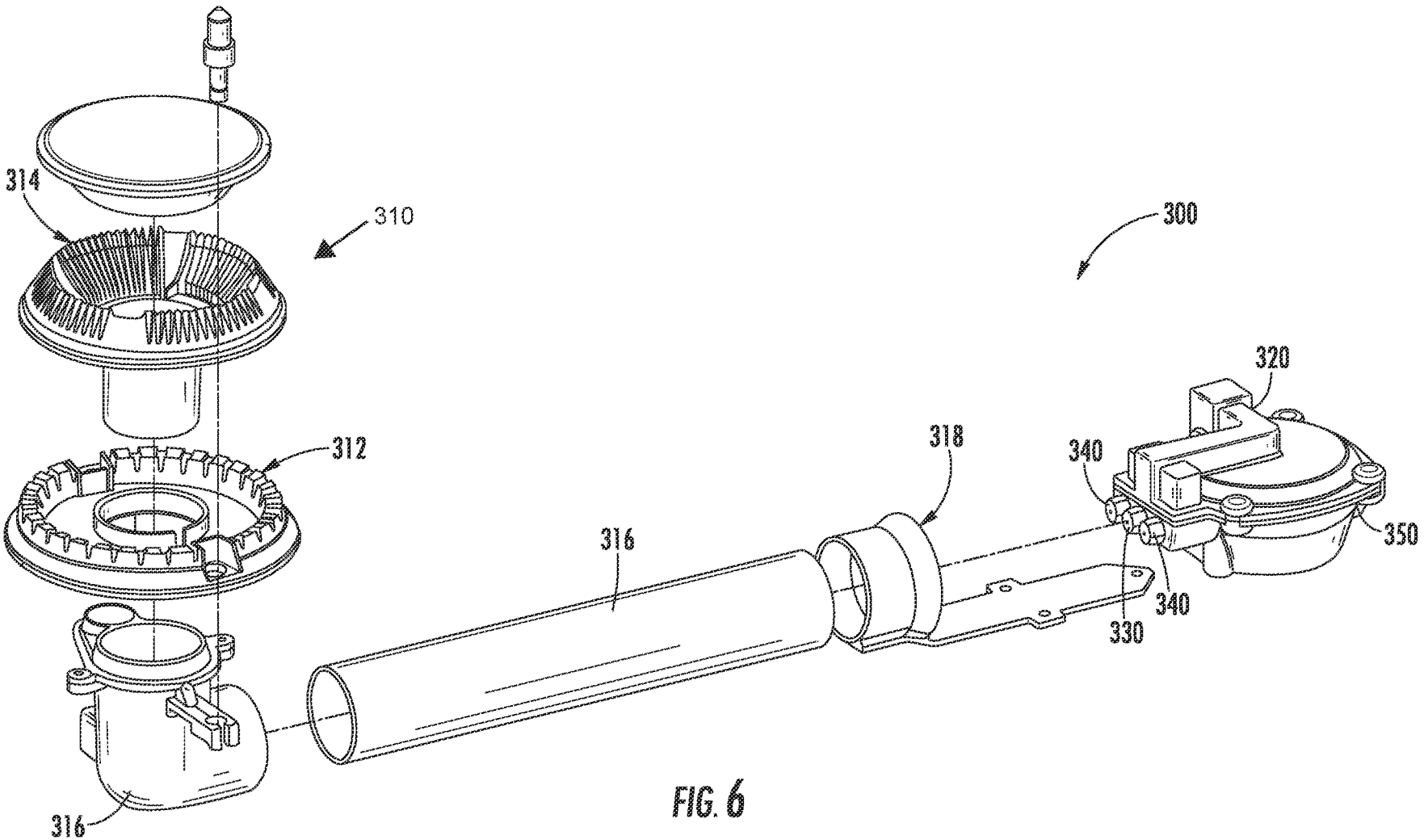
FIG. 6 is an exploded view of the example gas burner of FIG. 4.
Figure 7:
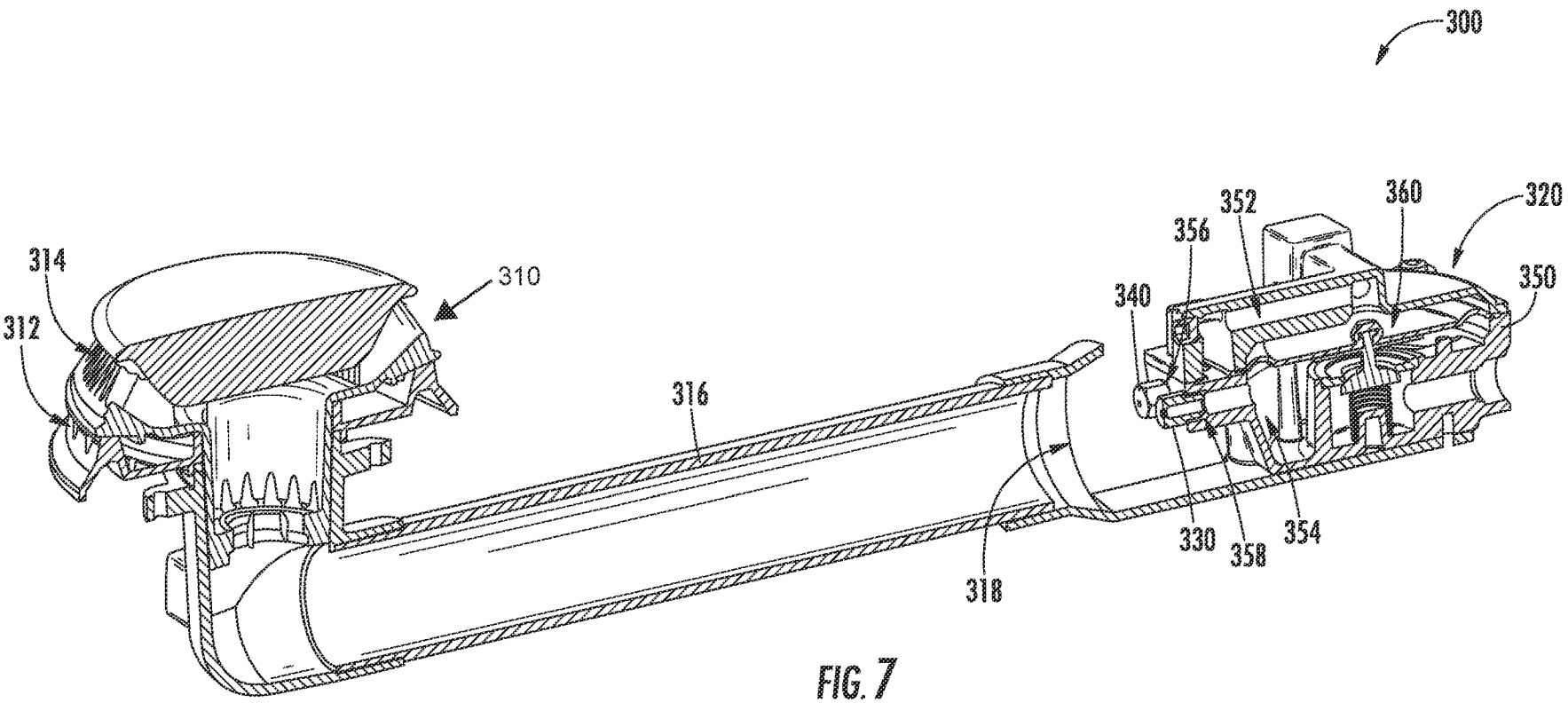

FIG. 2 is a top plan view of cooktop appliance 100. In FIG. 2, grates 110 are removed from top panel 102. As shown in FIG. 2, heating elements 104 includes a first gas burner 200 and a second gas burner 210. FIG. 3 is a top, perspective view of cooktop appliance 100. In FIG. 3, first gas burner 200 is removed from top panel 102. An opening 103 in top panel 102 is revealed when first heating element 200 is removed from top panel 102.

First gas burner 200 includes a burner body 202. Burner body 202 of first gas burner 200 defines a plurality of flame ports 208. During operation of first gas burner 200, a mixture of gaseous fuel and air may flow out of burner body 202 of first gas burner 200 through flame ports 208, and the mixture of gaseous fuel and air may be combusted outside of flame ports 208. Burner body 202 of first gas burner 200 is positioned on top panel 102 at opening 103 of top panel 102. Thus, e.g., burner body 202 of first gas burner 200 may rest on top panel 102 such that burner body 202 of first gas burner 200 covers opening 103. A fuel orifice of first gas burner 200 is positioned below top panel 102. In particular, the fuel orifice of first gas burner 200 may be positioned directly below opening 103 of top panel 102. Thus, the fuel orifice of first gas burner 200 may be accessible through opening 103 of top panel 102, and an installer may reach through opening 103 (e.g., with a wrench or other suitable tool) to change out the fuel orifice of first gas burner 200.

Second gas burner 210 includes a burner body 212 and a horizontal mixing tube 214. Burner body 212 of second gas burner 210 defines a plurality of flame ports 218. During operation of second gas burner 210, a mixture of gaseous fuel and air may flow out of burner body 212 of second gas burner 210 through flame ports 218, and the mixture of gaseous fuel and air may be combusted outside of flame ports 218. Second gas burner 210 may be operated independently of first gas burner 200. Thus, e.g., fuel flow through fuel orifice 206 of first gas burner 200 and fuel flow through fuel orifice 216 of second gas burner 210 may each be regulated with a respective one of control knobs 108.

Burner body 212 of second gas burner 210 is positioned on top panel 102 away from opening 103 of top panel 102. Thus, e.g., burner body 212 of second gas burner 210 may rest on top panel 102 such that burner body 212 of second gas burner 210 is spaced apart from opening 103. For example, burner body 212 of second gas burner 210 may be positioned on top panel 102 such that burner body 212 of second gas burner 210 is spaced from opening 103 of top panel 102 (e.g., and burner body 202 of first gas burner 200) by no less than five inches (5") and no more than twenty inches (20").

A fuel orifice of second gas burner 210 is positioned below top panel 102. In particular, the fuel orifice of second gas burner 210 may be positioned directly below opening 103 of top panel 102. Thus, the fuel orifice of second gas burner 210 may be accessible through opening 103 of top panel 102, and an installer may reach through opening 103 (e.g., with a wrench or other suitable tool) to change out fuel orifice 216 of second gas burner 210.

Horizontal mixing tube 214 is positioned below top panel 102. Horizontal mixing tube 214 extends in a generally horizontal manner between burner body 212 of second gas burner 210 and fuel orifice 216 of second gas burner 210. An inlet 219 of horizontal mixing tube 214 is positioned adjacent the fuel orifice of second gas burner 210. In particular, inlet 219 of horizontal mixing tube 214 may be spaced from and aligned (e.g., concentrically) with the fuel orifice of second gas burner 210. Thus, a flow of gaseous fuel from the fuel orifice of second gas burner 210 may flow horizontally into horizontal mixing tube 214 at inlet 219 of horizontal mixing tube 214. Between the fuel orifice of second gas burner 210 and inlet 219 of horizontal mixing tube 214, the flow of gaseous fuel may entrain air to facilitate combustion at flame ports 218.

Turning now to FIGS. 4 through 9, a gas burner 300 according to an example embodiment of the present disclosure is described. Gas burner 300 may be used in cooktop appliance 100, e.g., as second gas burner 210. Thus, gas burner 300 is described in greater detail below in the context of cooktop appliance 100. However, it will be understood that gas burner 300 may be used in or with any other suitable cooktop appliance in alternative example embodiments.

Gas burner 300 includes a burner body 310, which is a three-piece assembly in the illustrated example embodiment. Burner body 310 defines a plurality of naturally aspirated flame ports 312 and a plurality of forced induction flame ports 314. Naturally aspirated flame ports 312 may be distributed in a ring on burner body 310. Similarly, forced induction flame ports 314 may be distributed in a ring on burner body 310. Burner body 310 may also be stacked, e.g., such that forced induction flame ports 314 are positioned above naturally aspirated flame ports 312 on burner body 310. Thus, e.g., the ring of forced induction flame ports 314 may be positioned above the ring of naturally aspirated flame ports 312 on burner body 310. Burner body 310 may be positioned on top panel 102, e.g., in the manner described above for burner body 212 of second gas burner 210.

Naturally aspirated flame ports 312 may receive gaseous fuel from a gaseous fuel source 322, such as a natural gas line or propane line, when a user actuates one of control knobs 108 to adjust a control valve 304. Thus, e.g., a supply line 303 for naturally aspirated flame ports 312 may extend from gaseous fuel source 322 to an orifice 305 for naturally aspirated flame ports 312, and control valve 304 may be coupled to supply line 303.

Forced induction flame ports 314 may be plumbed in parallel to naturally aspirated flame ports 312 in gas burner 300. Thus, forced induction flame ports 314 may be capable of receiving gaseous fuel from gaseous fuel source 322 when the user actuates one of control knobs 108 to adjust control valve 304. Gas burner 300 also includes features for supplying air from a pressurized air source 324, such as an air pump or fan, to forced induction flame ports 314. Thus, forced induction flame ports 314 may operate with a higher flow rate of gaseous fuel and/or air compared to naturally aspirated flame ports 312. As an example, forced induction flame ports 314 may be activated by pressing a boost burner button 306 on control panel 106. In response to a user actuating boost burner button 306, pressurized air source 324 may be activated, e.g., with a timer control 308. Gas burner 300 also includes features for blocking the flow of gaseous fuel to forced induction flame ports 314 unless pressurized air source 324 is activated and/or pressurized air is suppled to forced induction flame ports 314, as discussed in greater detail below.

With reference to FIGS. 5 through 9, gas burner 300 includes an injet assembly 320. Injet assembly 320 is configured for directing a flow of air and gaseous fuel to forced induction flame ports 314 of burner body 310. Thus, as discussed in greater detail below, injet assembly 320 may be coupled to gaseous fuel source 322 and pressurized air source 324. During operation of gas burner 300, gaseous fuel from gaseous fuel source 322 and air from pressurized air source 324 may flow from injet assembly 320 into a horizontal mixing tube 316. Horizontal mixing tube 316 extends from an opening 318 adjacent injet assembly 320 to burner body 310. The gaseous fuel and air from injet assembly 320 may flow through horizontal mixing tube 316 to burner body 310, and the mixture of air and gaseous fuel may be combusted at forced induction flame ports 314. Injet assembly 320 may be positioned below top panel 102, e.g., below opening 103 of top panel 102 away from burner body 310.

Injet assembly 320 includes a gas outlet orifice 330, an air outlet orifice 340 and an injet body 350. Injet body 350 defines an air passage 352 and a gas passage 354. Air passage 352 may be in fluid communication with pressurized air source 324. For example, a pipe or conduit may extend between pressurized air source 324 and injet body 350, and pressurized air from pressurized air source 324 may flow into air passage 352 via such pipe or conduit. Gas passage 354 may be in fluid communication with gaseous fuel source 322. For example, a pipe or conduit may extend between gaseous fuel source 322 and injet body 350, and gaseous fuel from gaseous fuel source 322 may flow into gas passage 354 via such pipe or conduit.

Gas outlet orifice 330 is mounted to injet body 350, e.g., at an outlet 358 of gas passage 354. Thus, gaseous fuel from gaseous fuel source 322 may exit gas passage 354 through gas outlet orifice 330, and gas passage 354 is configured for directing a flow of gaseous fuel through injet body 350 to gas outlet orifice 330. On injet body 350, gas outlet orifice 330 is oriented for directing a flow of gaseous fuel towards forced induction flame ports 314, as discussed above. Gas outlet orifice 330 may be accessible through opening 103 of top panel 102 when injet assembly 320 is positioned below top panel 102 proximate opening 103 of top panel 102, and an installer may reach through opening 103 (e.g., with a wrench or other suitable tool) to change out gas outlet orifice 330.

Air outlet orifice 340 is mounted to injet body 350, e.g., at an outlet 356 of air passage 352. Thus, pressurized air from pressurized air source 324 may exit air passage 352 through air outlet orifice 340, and air passage 352 is configured for directing a flow of air through injet body 350 to air outlet orifice 340. On injet body 350, air outlet orifice 340 is oriented for directing a flow of air towards forced induction flame ports 314, as discussed above.

Figure 8:
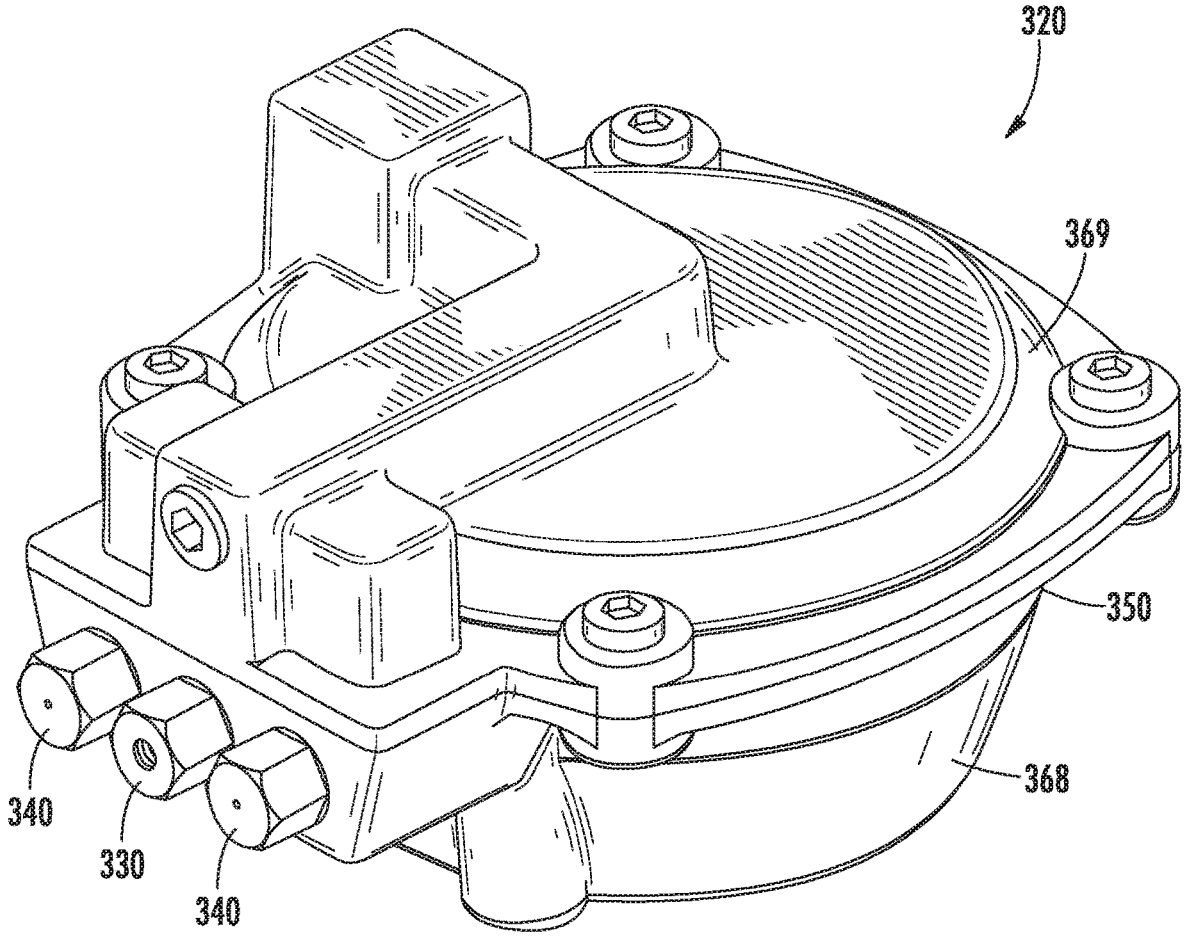
FIG. 8 is a perspective view of an injet of the example gas burner of FIG. 4.

As shown in FIG. 8, injet assembly 320 may include a plurality of air outlet orifices 340. Each of air outlet orifices 340 may be mounted to injet body 350 at a respective outlet of air passage 352. Air outlet orifices 340 are symmetrically positioned around gas outlet orifice 330 on injet body 350. As an example, in FIG. 9, injet assembly 320 has two air outlet orifices 340. One of the two air outlet orifices 340 is positioned opposite the other of the two air outlet orifices 340 about gas outlet orifice 330. Gas outlet orifice 330 may also be positioned concentrically to opening 318 of horizontal mixing tube 316. Such positioning of gas outlet orifice 330 and air outlet orifices 340 may improve fuel-air mixing, promote developed flow and improve air entrainment relative to asymmetrically distributed air outlet orifices 340.

Injet assembly 320 also includes a pneumatically actuated gas valve 360. Pneumatically actuated gas valve 360 is positioned within injet body 350, and pneumatically actuated gas valve 360 is adjustable between a closed configuration and an open configuration. In the closed configuration, pneumatically actuated gas valve 360 blocks the flow of gaseous fuel through gas passage 354. Conversely, pneumatically actuated gas valve 360 permits the flow of gaseous fuel through gas passage 354 to gas outlet orifice 330 in the open configuration. Pneumatically actuated gas valve 360 is configured to adjust from the closed configuration to the open configuration in response to the flow of air through air passage 352 to air outlet orifices 340. Thus, e.g., pneumatically actuated gas valve 360 is in fluid communication with air passage 352 and opens in response to air passage 352 being pressurized by air from pressurized air source 324. As an example, pneumatically actuated gas valve 360 may be positioned on a branch of air passage 352 relative to air outlet orifice 340.

Figure 9:
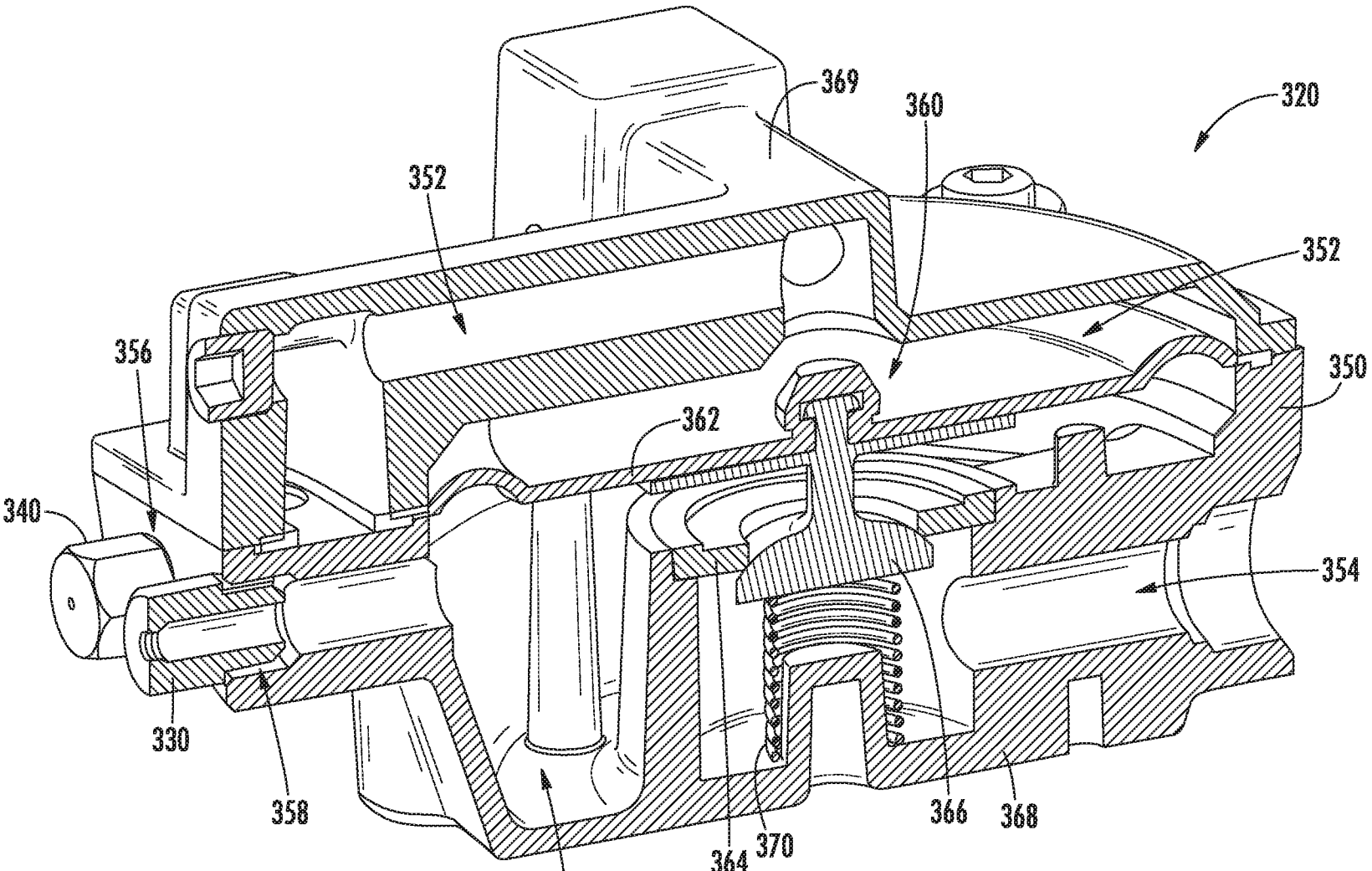
FIG. 9 is a section view of the injet of FIG. 8.

As shown in FIG. 9, pneumatically actuated gas valve 360 includes a diaphragm 362, a seal 364 and a plug 366. Diaphragm 362 is positioned between air passage 352 and gas passage 354 within injet body 350. For example, diaphragm 362 may be circular and may be clamped between a first injet body half 368 and a second injet body half 369. In particular, first and second injet body halves 368, 369 may be fastened together with diaphragm 362 positioned between first and second injet body halves 368, 369.

Seal 364 is mounted to injet body 350 within gas passage 354. Plug 366 is mounted to diaphragm 362, e.g., such that plug 366 travels with diaphragm 362 when diaphragm 362 deforms. Plug 366 is positioned against seal 364 when pneumatically actuated gas valve 360 is closed. A spring 370 may be coupled to plug 366. Spring 370 may urge plug 366 towards seal 364. Thus, pneumatically actuated gas valve 360 may be normally closed.

When air passage 352 is pressurized by air from pressurized air source 324, diaphragm 362 may deform due to the pressure of air in air passage 352 increasing, and plug 366 may shift away from seal 364 as diaphragm 362 deforms. In such a manner, diaphragm 362, seal 364 and plug 366 may cooperate to open pneumatically actuated gas valve 360 in response to air passage 352 being pressurized by air from pressurized air source 324. Conversely, diaphragm 362 may return to an undeformed state when air passage 352 is no longer pressurized by air from pressurized air source 324, and plug 366 may shift against seal 364. In such a manner, diaphragm 362, seal 364 and plug 366 may cooperate to close pneumatically actuated gas valve 360 in response to air passage 352 no longer being pressurized by air from pressurized air source 324.

As may be seen from the above, gas burner 300 includes a compact injet assembly 320. Thus, an installation footprint and/or required plumbing for gas burner 300 within cooktop appliance 100 may be reduced compared to known gas burners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner, comprising:

a burner body defining a plurality of forced induction flame ports;

a gas outlet orifice;

an air outlet orifice;

an injet body defining an air passage and a gas passage, the air outlet orifice mounted to the injet body at an outlet of the air passage such that the air outlet orifice is oriented for directing a flow of air towards the plurality of forced induction flame ports, the air passage configured for directing the flow of air through the injet body to the air outlet orifice, the gas outlet orifice mounted to the injet body at an outlet of the gas passage such that the gas outlet orifice is oriented for directing a flow of gaseous fuel towards the plurality of forced induction flame ports, the gas passage configured for directing the flow of gaseous fuel through the injet body to the gas outlet orifice;

a pneumatically actuated gas valve positioned within the injet body, the pneumatically actuated gas valve adjustable between a closed configuration and an open configuration, the pneumatically actuated gas valve blocking the flow of gaseous fuel through the gas passage in the closed configuration, the pneumatically actuated gas valve configured to adjust from the closed configuration to the open configuration in response to the flow of air through the air passage; and a mixing tube having an opening positioned adjacent the injet assembly, the mixing tube extending from the opening to the burner body, wherein the gas outlet orifice and the air outlet orifice on the injet body are spaced from the opening of the mixing tube by a gap that is contiguous with ambient air around the gas burner such that the flow of air from the air outlet orifice and the flow of gaseous fuel from the gas outlet orifice entrain the ambient air into the mixing tube.

2. The gas burner of claim 1, wherein the air outlet orifice is one of a plurality of air outlet orifices, the outlet of the air passage is one of a plurality of outlets of the air passage, each of the plurality of air outlet orifices mounted to the injet body at a respective one of the plurality of outlets of the air passage.

3. The gas burner of claim 2, wherein the plurality of air outlet orifices are symmetrically positioned around the gas outlet orifice on the injet body.

4. The gas burner of claim 1, wherein the air outlet orifice is one of a pair of air outlet orifices, the outlet of the air passage is one of a pair of outlets of the air passage, each of the pair of air outlet orifices mounted to the injet body at a respective one of the pair of outlets of the air passage, and one of the pair of air outlet orifices is positioned opposite the other of the pair of air outlet orifices about the gas outlet orifice.

5. The gas burner of claim 1, wherein the pneumatically actuated gas valve comprises:

a diaphragm positioned between the air passage and the gas passage within the injet body;

a seal mounted to the injet body within the gas passage; and a plug mounted to the diaphragm, the plug positioned against the seal in the closed configuration.

6. The gas burner of claim 5, wherein the diaphragm is a circular diaphragm.

7. The gas burner of claim 5, wherein the pneumatically actuated gas valve further comprises a spring coupled to the plug, the spring urging the plug towards the seal.

8. The gas burner of claim 5, wherein the injet body comprises a first injet body half and a second injet body half, the diaphragm clamped between the first injet body half and the second injet body half.

9. The gas burner of claim 1, wherein the injet body comprises a first injet body half and a second injet body half, an inlet of the air passage defined by the first injet body half, an inlet of the gas passage defined by the second injet body half.

10. A gas burner, comprising:

a burner body defining a plurality of forced induction flame ports;

an air outlet orifice configured for directing pressurized air towards the plurality of forced induction flame ports;

a gas outlet orifice configured for directing gaseous fuel towards the plurality of forced induction flame ports;

an injet body defining an air passage and a gas passage, the air outlet orifice mounted to the injet body at an outlet of the air passage, the gas outlet orifice mounted to the injet body at an outlet of the gas passage;

a pneumatically actuated gas valve positioned within the injet body, the pneumatically actuated gas valve blocking a flow of gaseous fuel in the gas passage when the pneumatically actuated gas valve is closed, the pneumatically actuated gas valve configured to open in response to pressurizing the air passage; and a mixing tube having an opening positioned adjacent the injet assembly, the mixing tube extending from the opening to the burner body, wherein the gas outlet orifice and the air outlet orifice on the injet body are spaced from the opening of the mixing tube by a gap that is contiguous with ambient air around the gas burner such that the flow of air from the air outlet orifice and the flow of gaseous fuel from the gas outlet orifice entrain the ambient air into the mixing tube.

11. The gas burner of claim 10, wherein the air outlet orifice is one of a plurality of air outlet orifices, the outlet of the air passage is one of a plurality of outlets of the air passage, each of the plurality of air outlet orifices mounted to the injet body at a respective one of the plurality of outlets of the air passage.

12. The gas burner of claim 11, wherein the plurality of air outlet orifices are symmetrically positioned around the gas outlet orifice on the injet body.

13. The gas burner of claim 10, wherein the air outlet orifice is one of a pair of air outlet orifices, the outlet of the air passage is one of a pair of outlets of the air passage, each of the pair of air outlet orifices mounted to the injet body at a respective one of the pair of outlets of the air passage, and one of the pair of air outlet orifices is positioned opposite the other of the pair of air outlet orifices about the gas outlet orifice.

14. The gas burner of claim 10, wherein the pneumatically actuated gas valve comprises:

a diaphragm positioned between the air passage and the gas passage within the injet body;

a seal mounted to the injet body within the gas passage; and a plug mounted to the diaphragm, the plug positioned against the seal the pneumatically actuated gas valve is closed.

15. The gas burner of claim 14, wherein the diaphragm is a circular diaphragm.

16. The gas burner of claim 14, wherein the pneumatically actuated gas valve further comprises a spring coupled to the plug, the spring urging the plug towards the seal.

17. The gas burner of claim 14, wherein the injet body comprises a first injet body half and a second injet body half, the diaphragm clamped between the first injet body half and the second injet body half.

18. The gas burner of claim 10, wherein the injet body comprises a first injet body half and a second injet body half, an inlet of the air passage defined by the first injet body half, an inlet of the gas passage defined by the second injet body half.

19. The gas burner of claim 1, wherein:

each of the gas outlet orifice, the air outlet orifice, and the gap has a respective length;

the gas outlet orifice extends from the injet body along the length of the gas outlet orifice;

the air outlet orifice extends from the injet body along the length of the air outlet orifice;

the gas outlet orifice and the air outlet orifice are spaced from the opening of the mixing tube along the length of the gap; and the length of the gap is greater than the lengths of the gas outlet orifice and the air outlet orifice.

20. The gas burner of claim 10, wherein:

each of the gas outlet orifice, the air outlet orifice, and the gap has a respective length;

the gas outlet orifice extends from the injet body along the length of the gas outlet orifice;

the air outlet orifice extends from the injet body along the length of the air outlet orifice;

the gas outlet orifice and the air outlet orifice are spaced from the opening of the mixing tube along the length of the gap; and the length of the gap is greater than the lengths of the gas outlet orifice and the air outlet orifice.

* * * * *